US007707657B2

(12) United States Patent
Kim

(10) Patent No.: US 7,707,657 B2
(45) Date of Patent: May 4, 2010

(54) HEADGEAR PROVIDED WITH A PONYTAIL

(76) Inventor: Dong Soo Kim, 109-3, Dongsan-dong, Dukyang-gu, Goyangshi, Kyungki-do 412-090 (KR)

( * ) Notice: Subject to any disclaimer, the term of this patent is extended or adjusted under 35 U.S.C. 154(b) by 396 days.

(21) Appl. No.: 10/240,103

(22) PCT Filed: Mar. 27, 2001

(86) PCT No.: PCT/KR01/00493

§ 371 (c)(1),
(2), (4) Date: Sep. 27, 2002

(87) PCT Pub. No.: WO01/72159

PCT Pub. Date: Oct. 4, 2001

(65) Prior Publication Data

US 2003/0106134 A1 Jun. 12, 2003

(30) Foreign Application Priority Data

Mar. 27, 2000 (KR) ..... 2000-15633

(51) Int. Cl.
*A42B 1/00* (2006.01)

(52) U.S. Cl. ..... 2/209.12; 2/175.6

(58) Field of Classification Search ..... 2/175.6, 2/202, 209.11–209.13, 174, 206
See application file for complete search history.

(56) References Cited

U.S. PATENT DOCUMENTS 946,770 A * 1/1910 Sands ..... 2/68
1,105,400 A * 7/1914 Burke ..... 2/171.5
1,598,379 A * 8/1926 Kerr ..... 2/171.02
2,295,826 A * 9/1942 Brav ..... 2/172
2,735,110 A * 2/1956 Baker ..... 2/209.12
2,897,510 A * 8/1959 Forbes-Robinson ..... 2/172
3,327,720 A * 6/1967 Carmony et al. ..... 132/274
3,392,737 A * 7/1968 Fefferman ..... 132/274
4,329,742 A * 5/1982 Schuessler ..... 2/424
5,153,943 A * 10/1992 Clement ..... 2/418
5,293,646 A * 3/1994 Winston ..... 2/88
D346,893 S * 5/1994 St-Germain ..... D2/866
5,542,127 A * 8/1996 Bezanis ..... 2/172
5,623,732 A * 4/1997 Olajide, Jr. ..... 2/195.1
5,694,647 A * 12/1997 Crickmore ..... 2/172
5,906,006 A * 5/1999 Castro, Jr. ..... 2/207
6,049,904 A * 4/2000 Siracusa ..... 2/4
6,233,738 B1 * 5/2001 Siracusa ..... 2/4

FOREIGN PATENT DOCUMENTS

JP 53-95743 8/1998
KR 96-3709 2/1996
KR 99-81380 11/1999

* cited by examiner

*Primary Examiner*—Katherine Moran
(74) *Attorney, Agent, or Firm*—Birch, Stewart, Kolasch & Birch, LLP

(57) ABSTRACT

The present invention provides a top knot cap (headgear provided with a ponytail) comprising the upper top knot portion (22) formed by extending the top knot portion (20) connected to the crown (10) and the said upper top knot portion (22) may be bundled with the binding cord (31) to form a ponytail or unfurled to cover the neck. The top knot cap may be provided with the meeting and parting portion (23) that splits apart when the said top knot portion (20) is unfurled. The inventive top knot cap may protect the head part of a user and further express various designs full of ornamental effects.

11 Claims, 8 Drawing Sheets

HEADGEAR PROVIDED WITH A PONYTAIL

This application is the national phase under 35 U.S.C. §371 of PCT International Application No. PCT/KR01/00493 which has an International filing date of Mar. 27, 2001.

FIELD OF THE INVENTION

The present invention concerns with a top knot cap (headgear provided with a ponytail) that performs multiple functions, such as convenient movement of head up and down and assurance of ventilation inside the cap, as well as increase of ear function, protection of neck and insulation of heat outside the cap.

BACKGROUND OF THE INVENTION

Generally speaking, the shape of a cap varies according to use and function. Most of caps are composed of the crown that covers the head and the visor that cuts off the light from the sun. Some kind of cap, such as hunting cap, is equipped with the ear flaps to protect the ears in winter time. However, most of the caps are prepared for a simple function.

Speaking more in details;

Problems neglected in composing the caps so far are preparation of enough space up to the summit of crown for the convenient movement of head up and down and assurance of ventilation inside the cap, as well as protection of face, method of attaching the ear flap to increase the ear function and neck cover to protect the neck outside the cap. Among the cap makers, such problems have not been considered important so far.

The matter of head movement up and down inside the crown of cap is important to level up the status of ready-made cap, currently produced in a number of standard patterns, to that of a cap made to measurement. In an attempt to adjust standard size caps to the heads of varied sizes as if they are made to measurement, flexibility devices are provided at the back edge of cap, to attain the effect of free-size caps. On the assumption that the relative height of head following the size of head is proportionate to the size of edge, the relative height was thought adjustable by adjusting the size of edge. However, in producing the caps, the relative height of crown of cap is ready made in certain patterns while only the edges are made adjustable. Therefore at the actual use of cap, the problem of relative height becomes outstanding unexpectedly. Sometimes the edge of cap comes down to touch the wearer's ear, or sometimes it remains too high from the level of one's ear so that the cap might be blown away by the wind. To solve such shortcomings, the depth of cap should have a system of adjustment as the back edge of cap is equipped with the flexibility device. For this object, the summit of crown needs to be elastic to assure the space for head movement.

So far, the problems of ventilation and change of air have been underestimated, and a few number of little holes on the crown were not enough to satisfy the absolute quantity of air. Such underestimation came probably from the fact that the cap is easier to be taken off than the shoes are, though keeping the cap in one's hand is inconvenient. So, it is actual that taking hat off is difficult while taking shoes off is not so difficult. It is indeed inside the cap that the health principle of keeping head cool and feet warm is neglected. Therefore the entire cap should be remodeled to improve the volume of ventilation.

The neck cover was attached for protection of skin in the summer and for prevention of cold air in the winter. However, one stretch of thick cloth was stitched into the edge of cap without distinction of neck or ear cover while it was actually both for neck and ear. As it is unable to equip the back edge of cap with flexibility device, the result was the unpleasant feeling coming from tight contact of cap with the skin. Also, the up-lifted neck cover when not in use and the unusual thickness of edge due to the stitch-in of neck cover decreased the beauty point.

In consideration of those problems as mentioned so far, the author invented a top knot cap (headgear provided with ponytail) composed of the top knot function added to the existing cap and had it registered for a number of design rights and utility model rights.

However, there exist various problems, such as limitation in expressing the designs of cap by connecting the knot portion and in the degree of utilization, while the summit of top knot portion connected to the crown of cap was made to be bound or unfastened by the use of binding cord, showing the function of opening or closing the summit of cap.

DETAILED DESCRIPTION OF THE INVENTION

The top knot portion of the present invention is usually bound by the cord to form the top knot, and when unfurled, it turns out to cover face, ear, neck and even the cap itself. This top knot cap is purposed to protect the human body, performing multiple functions as well as exhibiting varied designs.

To realize the object of the present invention as mentioned so far, it is characteristic of the following designs.

A top knot cap (Headgear provided with pony tail) characterized in that the top knot portion (20) connected to the crown (10) comprises the upper top knot portion (22) that becomes the cover when puckered up, and that it may be lowered in a state of being bundled by the binding cord (32) or may be unfurled to become the neck cover. The binding cord (31) equipped at the summit of top knot portion (20)

DESCRIPTION OF CODE FOR THE MAJOR PARTS OF DRAWINGS

10: Crown
20: Top knot portion
30: Binding portion
40: Summit (interior cover)

BEST EXAMPLE OF THE INVENTION IN ACTUAL USE

Figure 1:
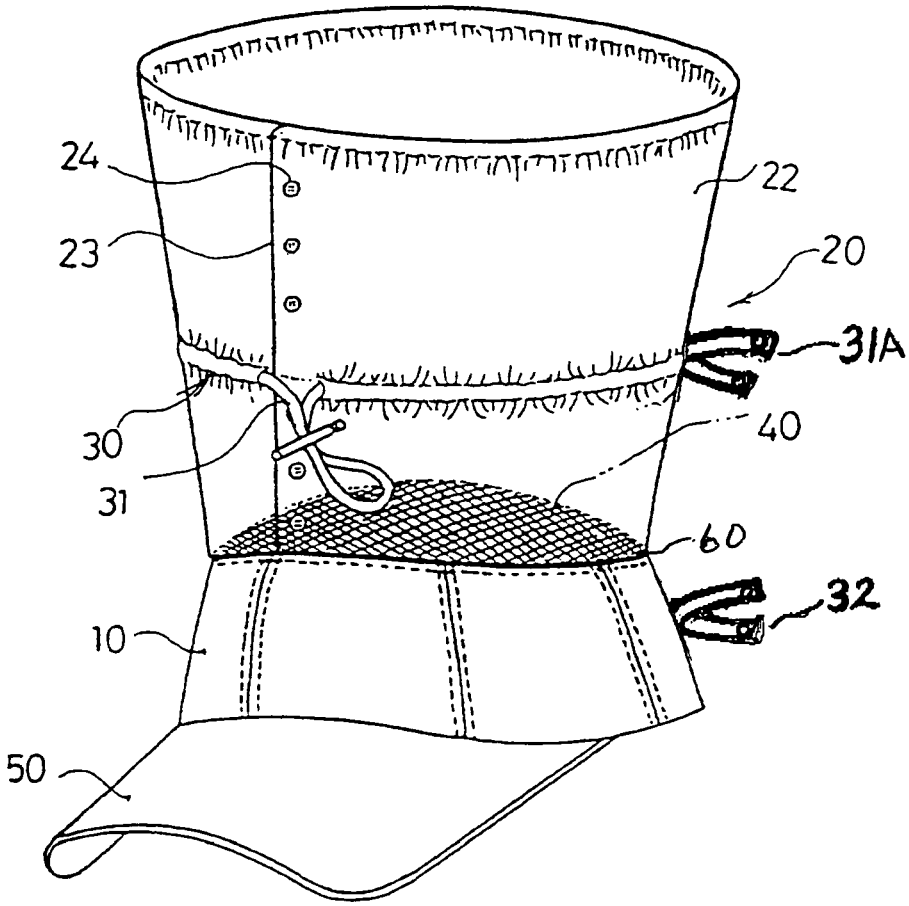
FIG. 1 is the fundamental design of top knot cap of the present invention.

Following the accompanying drawings hereunder, best examples of the present invention in actual use are explained as follows;

FIG. 1 is the fundamental design of the present invention.

The top knot portion (20) is connected to the round line appropriately located on the crown of cap, and the binding cord (31) is located at the position where the top knot portion (20) is to be puckered to come together, thus forming the binding portion (30). Further the upper top knot portion (22) for neck-cover function is formed by extending the lower top knot portion (20) to the length of reaching down farther than the edge of crown of cap (10) when unfurled.

Vertically on the front side of top knot portion (20), the open/close line (23) is formed so that the top knot portion can be opened, and as the materials (24) for the open/close line, buttons are depicted. Cord and zipper also can replace the buttons for the open/close line materials (24) of the meeting and parting portion (23).

For the top knot portion (20) to be connected to or disconnected from the crown of cap, such materials (11) as zipper, buttons, cord, or link can be used.

The open/close line (23) on the top knot portion (20) may be made in double or more on the entire portion or partial portion of top knot portion (20) either vertically or horizontally.

Code 40 is an interior cover (summit) for covering the open portion of crown, appearing inside the connection portion between the crown (10) and the top knot portion (20). While it is sketched in a network style, it is not a required part of the present invention but a selective one.

So far, the top knot portion (20) is to be stitched or connected to the crown (10) by using the materials (11) of fixing or removing function. Now another method is to have the crown itself (10), without having the necessity of connecting the top knot portion to it, extended to the length of reaching farther down than the edge line of crown (10), when unfurled, to form the upper to knot portion of neck-cover function (22). Such as, method of connecting top knot portion includes extending the crown (10).

The code 50 is a visor.

Figure 2:
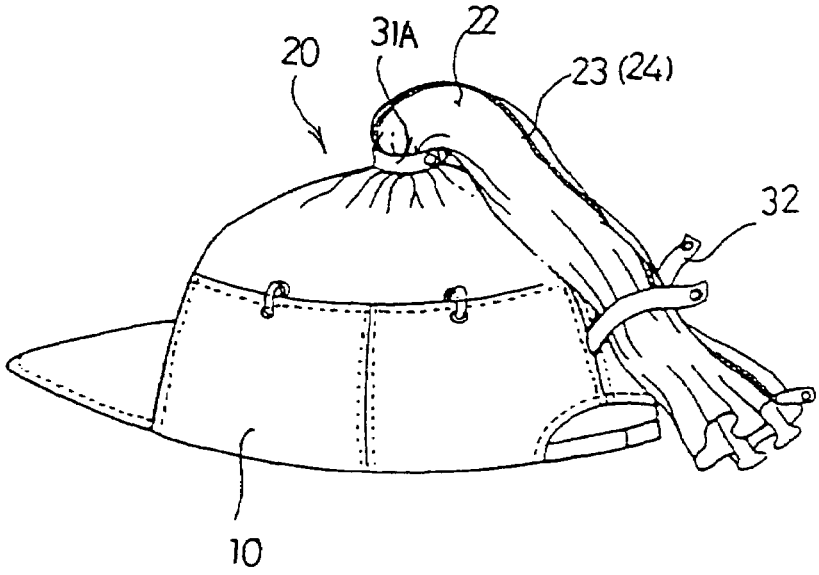
FIG. 2 is the state of top knot portion bound.

FIG. 2 shows the state of top knot bound on the cap.

When the top knot portion (20) is puckered up and bound by the binding cord, the extended upper top knot portion (22) looks like a pony tail flowing down farther than the edge of cap. To prevent the upper top knot portion from swinging left and right, cord (32) located at the back of crown (10) may bind the down-flowing upper top knot portion (22).

When the top knot portion (20) is to be applied to the sun visor and connected to its band, the fixed cord of top knot portion can be set at the upper top knot portion (22) beside the binding cord (31).

Cord (32) is of many types, such as encircling cord, cord hidden inside the top knot portion, another exterior ring, exterior binding cord or so forth. Especially the materials for woman to bind their hair, such as rubber ring clip, and so forth may be used for such purpose. For example, the cord can be attached at the inside of the crown (33) or the cord can be fixed inside the rolled-up top portion.

Also, as method of connecting or removing the top knot portion (20) to and from the crown (10), punchings may be made on the upper edge of crown and bottom edge of top knot portion so that the connection may be made by the use of rings though the punchings.

As materials of top knot portion (20), artificial hair and versatile ways of binding them, such as dividing them in a number of lines as can be seen in the fashion styles, may be used. In each hair-making pattern, ornament or artful cover may be used as a character article, for an instance, a dragon symbol.

Figure 3:
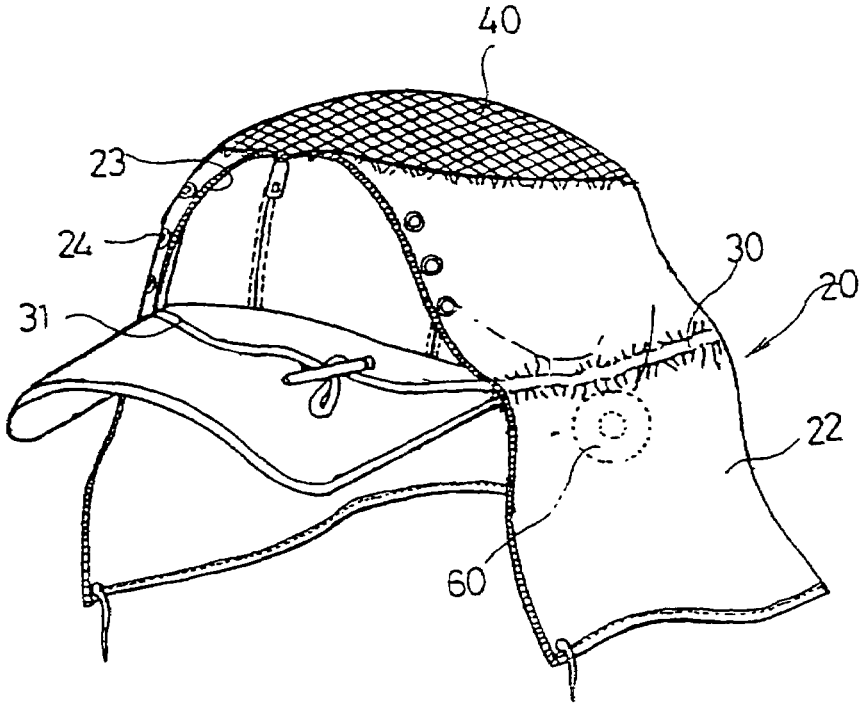
FIG. 3 is the state of top knot portion unfurled.

FIG. 3 is the state of top knot portion of FIG. 2 unfurled down.

When the binding cord (31) is unfastened, the open/close line (23) will be opened by the use of open/close line materials (24), and then the top knot portion (20) will be unfurled down with the inside turned out. Then the upper top knot portion (22) extended from the top knot portion (20) will come down farther to perform the neck cover function. Also as the top knot portion (20) gets unfurled to the outside of crown (10), the interior cover (summit) equipped at the connection line of crown (10) and top knot portion (20) appears open to the outside air, and performs its ventilation function through the network. Also, the quantity of ventilation may be adjusted by the degree of opening the top knot portion.

Further, beside the neck cover function, attachable to the place appropriate to the ear are such communication systems as ear phone (60), sound reflection appliance, or noise-prevention set-up which will assist the wearer indirectly to direct his attention forward.

Also as the materials of top knot portion (20), those of specific functions, such as vinyl instead of natural fiber or synthetic fiber, may be used for the purpose of multiple functions, such as water-proof, cutting off ultra-violet ray or electric wave and so on. The interior or the exterior side of top knot portion may also be used for placing the sun ray condenser or the printed advertisement.

Figure 4:
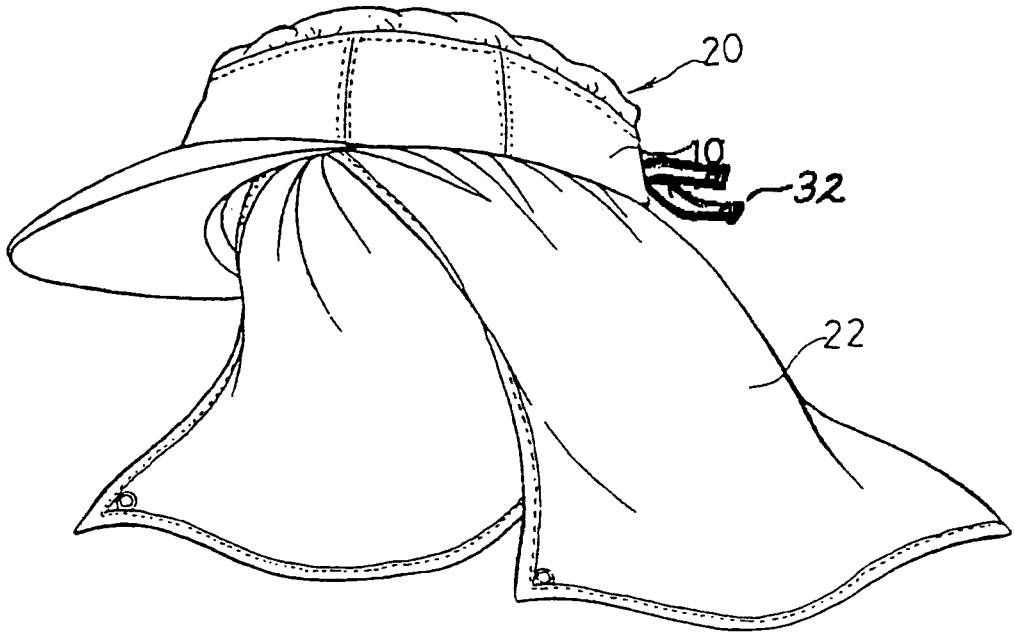
FIG. 4 is the state of top knot portion unfurled down to the inside of cap.

FIG. 4 illustrates the case of top knot cap without the interior cover (summit). In case of the close interior cover equipped at the upper edge of crown (10), the top knot portion (20) can only be spread down to the outside of the crown while in case of no interior cover or open interior cover, the top knot portion may be spread either to the outside or to the inside of crown.

Figure 5:
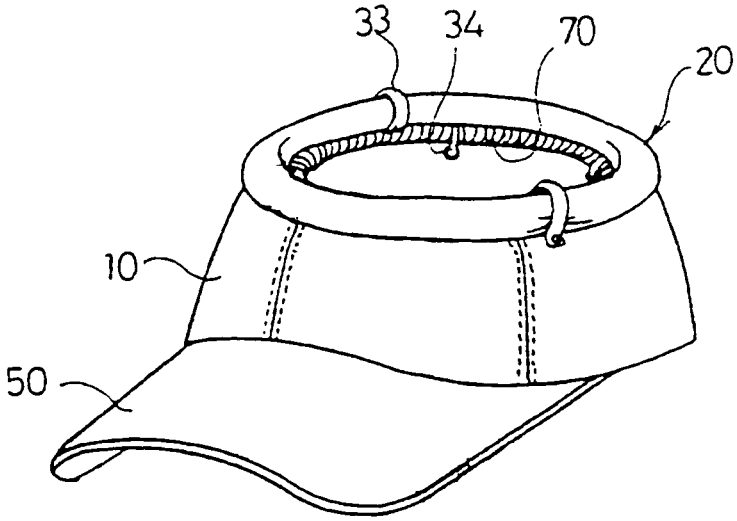
FIG. 5 is the state of top knot portion rolled, and shows how the ring is connected to it.

FIG. 5 shows the state of ring set up at the rolled-up top knot portion of cap. Top knot portion (20) is rolled-up and fixed by the cord (33) attached at the inside of crown and the corresponding button attached at the outside of crown. so the upper portion of cap gets open. Further another cord (34) fixed inside the rolled-up top knot portion (20) binds and fixes the ring (70) that supports the crown (10) and the interior cover (Flat top).

To the ring (70) mentioned above, either a network cloth or cloth with open/close line on it shall be connected so that it may perform the function of interior cover (summit) as well as ventilation.

Figure 6:
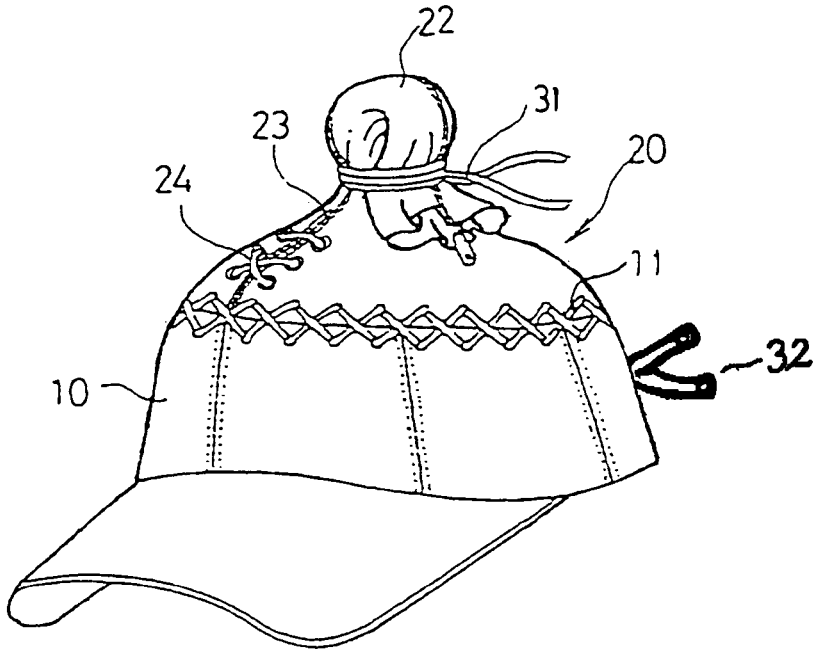
FIG. 6 is the state of top knot portion bound in double.

FIG. 6 shows the state of top knot portion (20) folded and bundled up by the binding cord. It is characteristic of the extended upper top knot portion (22) folded and bundled up together with the first one to form one top knot. As the materials (24) for open/close line (23), either zipper or cord is used. In case of cord, it is depicted as intertwining through the punctures. And the top knot portion (20) is connected to the crown (10) by a cord (11) running in a zigzag form through the holes punctured along the connecting line up and down and connecting or disconnecting the top knot portion to or from the crown.

Figure 7:
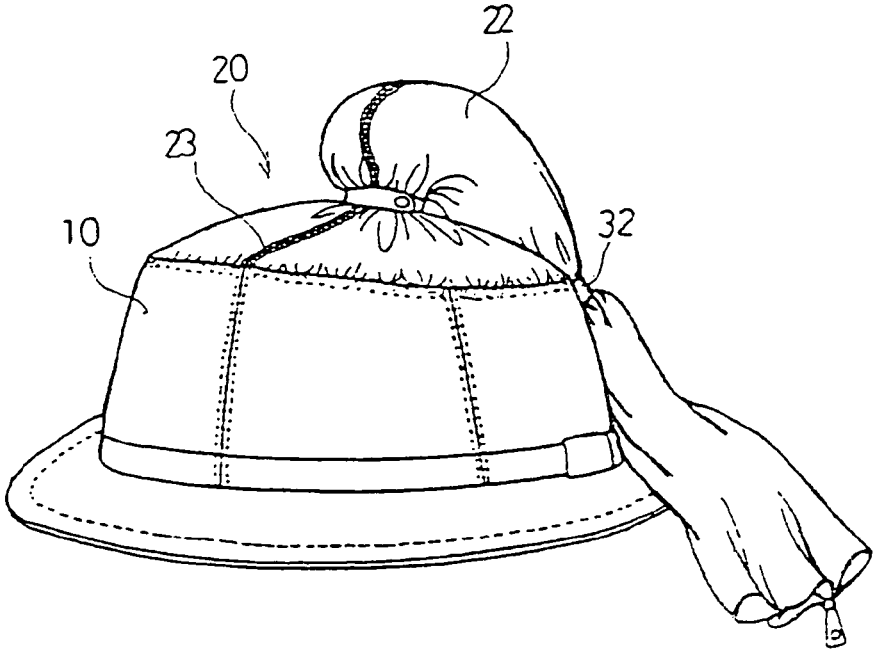
FIG. 7-9 are the state of the present invention applied to the safari cap.
Figure 8:
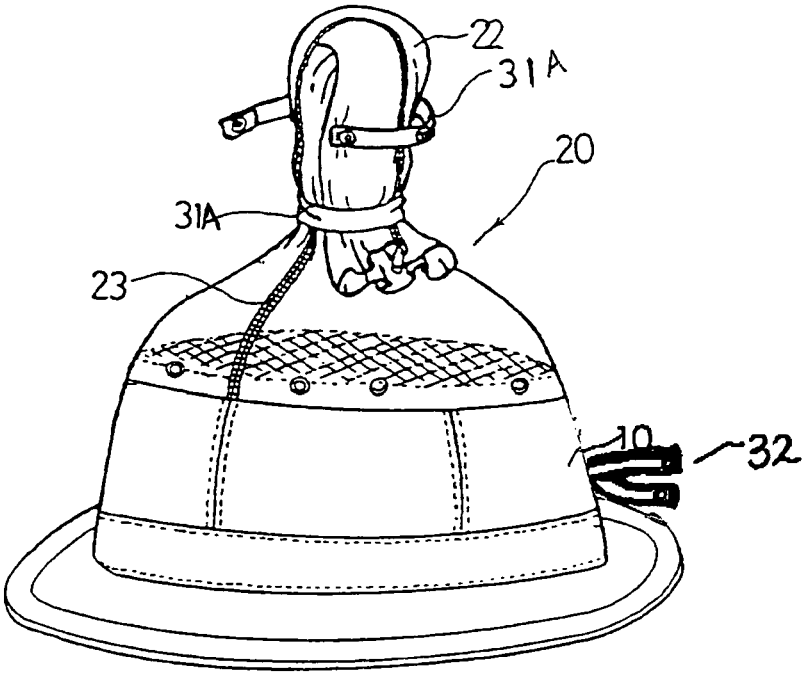
Figure 9:
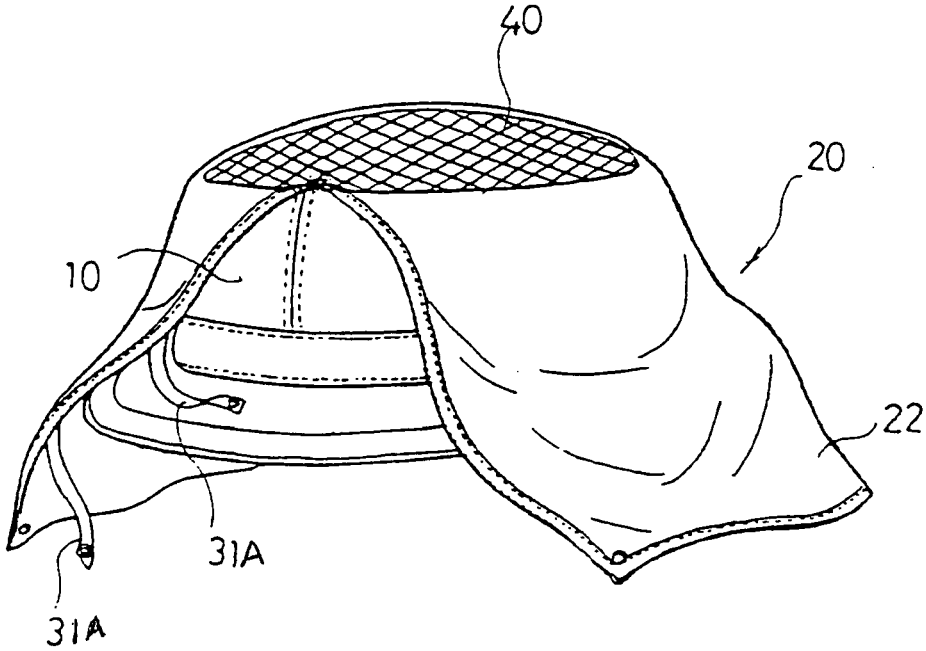

FIG. 7-9 is the state of pony tail top knot type applied to the safari cap. As in the FIG. 2, the upper top knot portion (22) of top knot portion (20) connected to the safari cap is further extended to reach the lower back part of cap and bound by the cord.

FIG. 8 is the state of upper top knot portion (22) folded and bundled together with the top knot portion (20) into one top knot, like in the FIG. 6.

FIG. 9 shows the state of the binding cord (31) applied to the safari cap and unfastened. When the top knot portion (20) is made to run down with the inside turning out, the upper top knot portion (22) reaches down to the neck position and performs the neck-cover function.

As mentioned so far, the function of top knot of the present invention can also be applied to various caps as seen in the case of safari cap.

Figure 10:
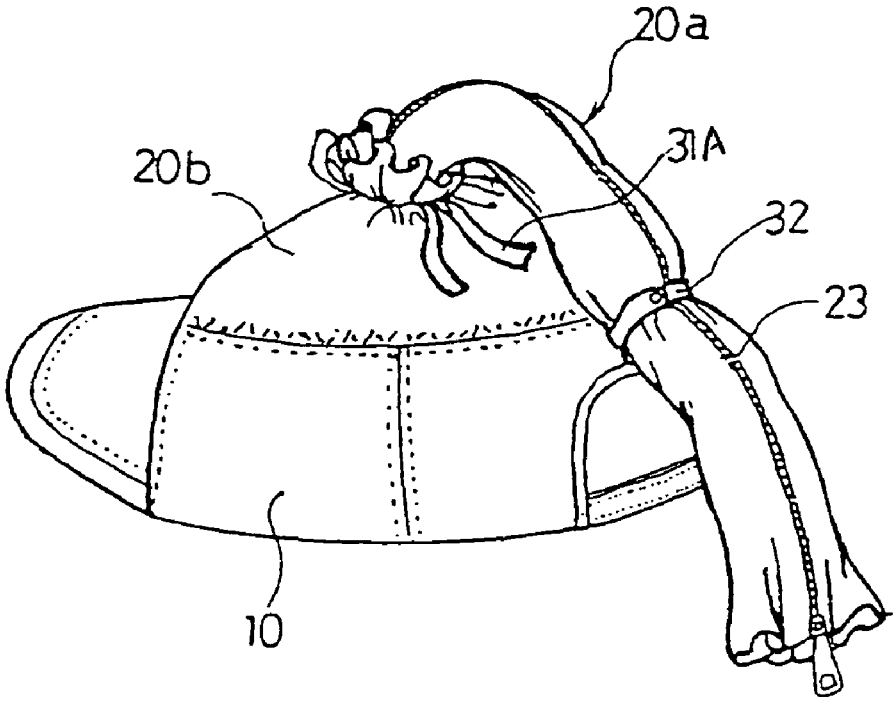
FIG. 10 is the state of top knot portion designed in double.

FIG. 10 shows the state of double top knots applied to the cap.

For connecting the top knot portion (20) to the crown of cap, top knot portions (20*a*) (20*b*) are prepared in double to be connected to the crown, with the interior top knot portion (20*a*) the longer and the exterior top knot portion (20*b*) the shorter, and the knot portion formed by the puckering to form the knot is bound by the cord (21).

The interior top knot portion (20*a*) performs the function of neck cover. It can be spread both to the inside and to the outside of crown (10) and when it is spread to the inside, the exterior top knot portion (20*b*) still can perform the function of ventilation and exterior cover. Cap wearer may decide how to use, selectively.

Or the interior top knot portion (20*a*) may be made shorter, and the exterior top knot portion (20*b*) the longer and in this case, an interior cover made of network cloth may be attached to the inside of the interior top knot portion (20*a*) so that it may contain various kind of necessary things in the space between, to perform the function of pocket. At this time, the exterior top knot portion (20*b*) may be made to spread to the outside of crown (10). This double top knot portions as such belong to the fundamental invention to advance the practical and aesthetic value of top knot portion.

Figure 11A:
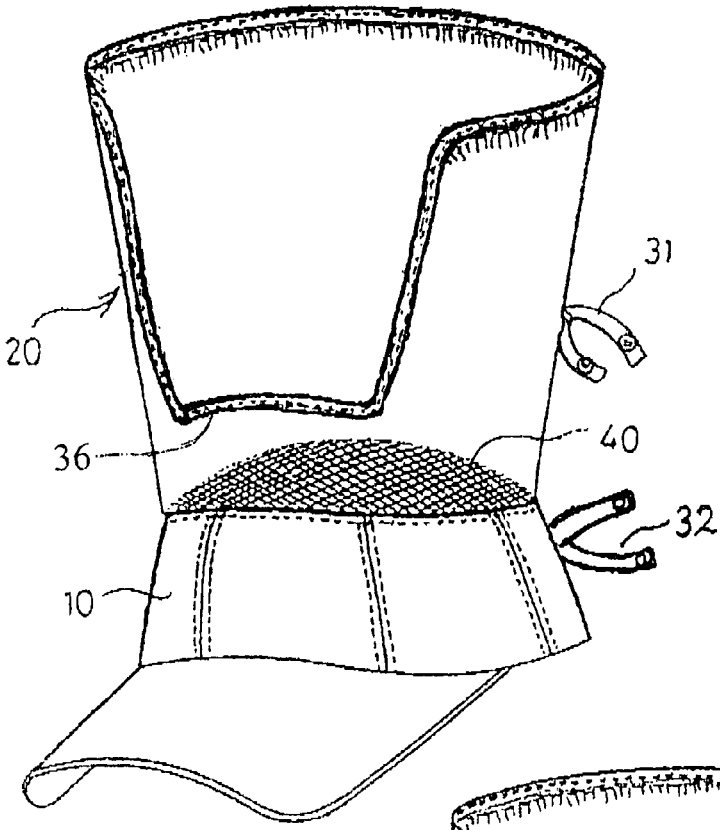
FIGS. 11A and B are two designs of top knot portion each without the open/close line.
Figure 11B:
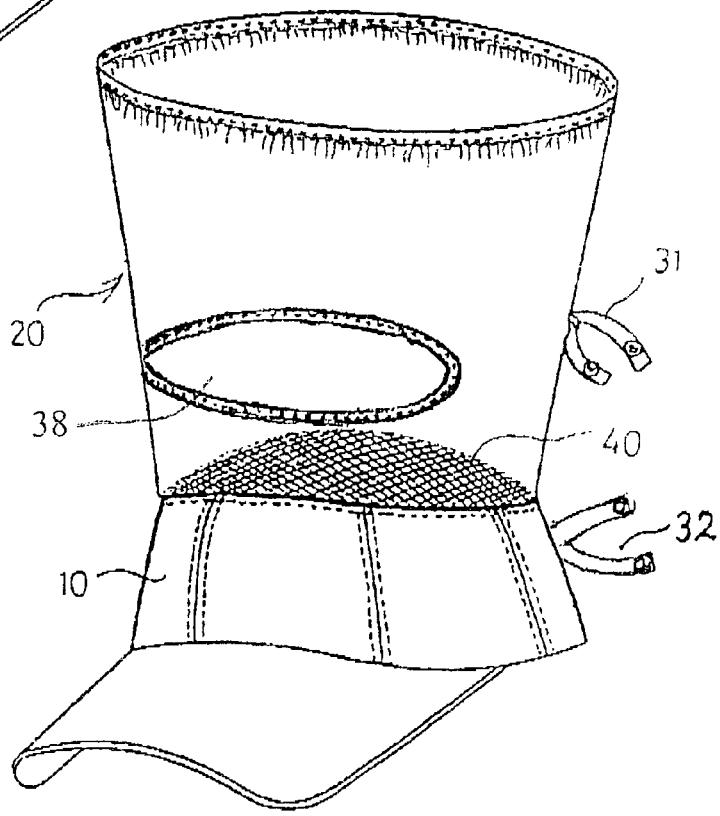

In the FIGS. 11A and 11B, the open/close line (23) is not formed on the top knot portion (20). Instead, the knot portion connected to the crown (10) is made long enough to cover the neck when unfurled, and in this case, the diameter of top knot portion gets wider as it goes upward so that it may be readily pulled down to the level of neck, uninterrupted by the visor. To prevent the interruption by the visor when the top knot portion is to be pulled down with the inside turned out, the front part of it may be made shorter (36) while the back part the longer, so that the front part may be stopped at the visor, as shown in FIG. 11A. For the top knot portion of wool cap for winter, hole (38) may be prepared to let the visor and face come out of the top knot portion spread, as shown in FIG. 11B. While the binding cord is attached like a link at the backside of top knot portion (20), it may be changed according to necessity.

Figure 12:
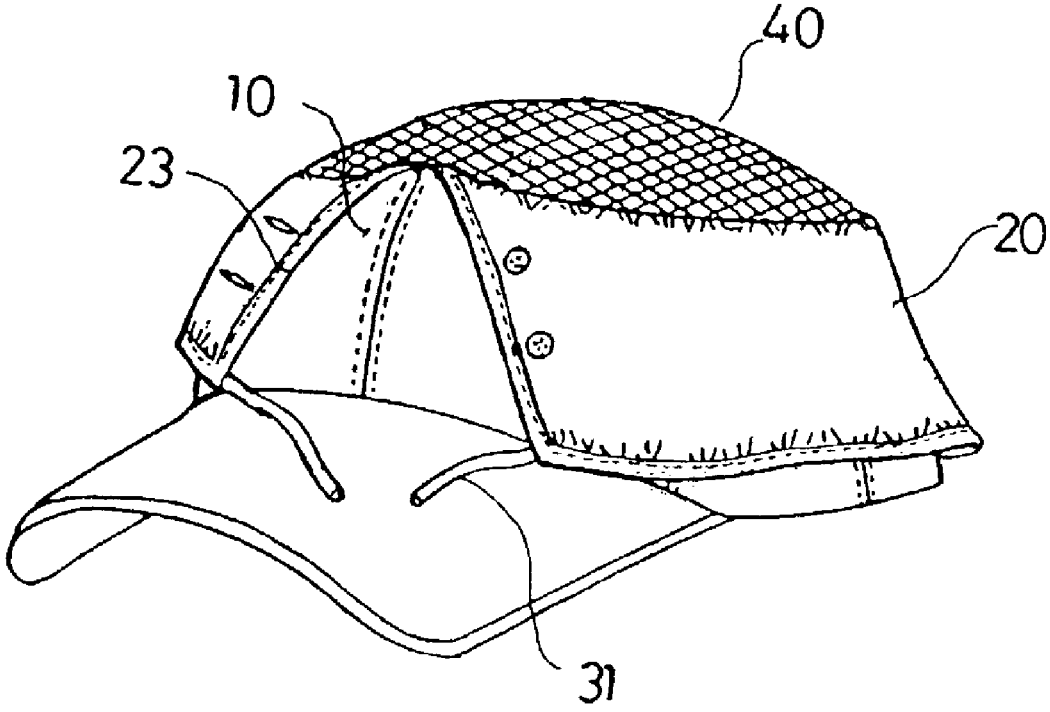
FIG. 12 is the state of unfurled top knot portion, with the function of open/close line.

FIG. 12 shown the partable open/close line (23) formed perpendicularly on the top knot portion (20) where the binding cord (31) is equipped to bind the puckered-up summit portion connected to the crown (10) of cap, providing the function of top knot portion (20) to become a cover when bound and to ventilate when unfurled.

FIG. 12 is a small type of top know portion (20) formed by combining the open/close line to the top knot portion 20, and when applied to the sun cap (visors), it can be used as the neck cover shown in FIG. 4.

INDUSTRIAL AVAILABILITY

Diverse functions of the present invention of top knot cap can be brought forth by simple handling. When the top knot portion is opened, ventilation and the space necessary for the movement of head up and down inside the cap can be assured and further, with the interior cover (40) and the open/close line, their quantity and degree can be adjusted. When the unfurled top knot portion gets puckered up and bound, or the spread down top knot portion gets bound, it becomes either a top cap or a fashionable pony tail cap. When the top knot portion gets unfurled down to the inside, or to the outside, it will have diverse utilities of protecting face, ears, eyes, or even the neck. Not only such diverse functions, the utility of cap will be heightened greatly when various designs are attached to it. Also in accordance with the use of selected functional materials for the top knot portion, it will perform the functions of water-prevention, electron wave prevention, ultra-violet ray prevention and so forth. With fixing communication system or advertisement materials to the cap, it can meet the requirements of information age.

The invention claimed is:

1. A top knot cap comprising:

a crown having an upper connecting portion and a lower connecting portion; and a top knot portion having a first edge connected to the upper connecting portion of the crown that becomes a cover when puckered up, and a second edge spaced from the first edge;

a binding cord attached to the top knot portion between the first and second edge;

wherein said top knot portion may be lowered in a bundled state or may be unfurled to become a neck cover, wherein the top knot portion has an open/close line from a top of the top knot portion to a lower portion of the top knot portion so that the top knot portion can be selectively separated when said top knot portion is unfurled, and further comprising a second binding cord mounted on a back portion of the crown for holding the top knot portion in the bundled state and to form the top knot portion as a ponytail.

2. The top knot cap according to claim 1, wherein the second binding cord mounted on the back portion of the crown is coupled around the top knot portion to hold the top knot portion in the bundled state and to form the top knot portion as a fashionable ponytail and is uncoupled from the top knot portion to unfurl the top knot portion to become the neck cover.

3. A top knot cap comprising:

a crown having an upper connecting portion and a lower connecting portion; and a top knot portion having a first edge connected to the upper connecting portion of the crown that becomes a cover when puckered up, and a second edge spaced from the first edge;

a binding cord attached to the top knot portion between the first and second edge;

wherein said top knot portion may be lowered in a bundled state or may be unfurled to become a neck cover, wherein the top knot portion has an open/close line from a top of the top knot portion to a lower portion of the top knot portion so that the top knot portion can be selectively separated when said top knot portion is unfurled, and wherein the top knot portion is connected to the upper connecting portion of the crown such that a connection line between the top knot portion and the upper connecting portion of the crown forms a substantially 360 degree circular connection line.

4. A top knot cap, comprising:

a crown having an upper connecting portion and a lower connecting portion, said upper connecting portion being higher than lower connecting portion; and a top knot portion having a first edge connected to the crown at the junction of the upper connecting portion and the lower connecting portion; and a plurality of binding cords attached proximate the top knot first edge, the cords having a first end fastened to the upper connecting portion and a second end connected to the lower connecting portion, wherein when the top knot portion is puckered up, the top knot portion rises and stands above the crown in an extended state with a top of the top knot portion being wider than a bottom of the top knot portion connected to the upper connecting portion of the crown.

5. A top knot cap, comprising:

a crown having an upper connecting portion and a lower connecting portion, said upper connecting portion being higher than lower connecting portion; and a top knot portion having a first edge connected to the crown at the junction of the upper connecting portion and the lower connecting portion; and a plurality of binding cords attached proximate the top knot first edge, the cords having a first end fastened to the upper connecting portion and a second end connected to the lower connecting portion, wherein the top knot portion is connected to the upper connecting portion of the crown such that a connection line between the top knot portion and the upper connecting portion of the crown forms a substantially 360 degree circular connection line.

6. A top knot cap comprising:

a crown having an upper connecting portion and a lower connecting portion; and a top knot portion having a first edge connected to the upper connecting portion of the crown that rises and stands above the crown such that a top of the top knot portion is wider than a bottom of the top knot portion connected to the upper connection portion of the crown, wherein said top knot portion may be lowered in a bundled state, may be unfurled to become a neck cover or may become a cover when puckered up; and a binding cord connected to a back of the crown whereby the topknot portion can be bundled into a ponytail.

7. The top knot cap according to claim 6, further comprising an interior net cover inside a connecting line of the said crown and top knot portion.

8. The top knot cap according to claim 6, further comprising open/close materials to open or close two ends of said top knot portion at an open/close line.

9. The top knot cap according to claim 6, further comprising a connecting/removal device to connect or to remove said top knot portion from the crown of the cap.

10. The top knot cap according to claim 6, further comprising a cord mounted on a back portion of the crown for holding the top knot portion in the bundled state and to form the top knot portion as a ponytail.

11. A top knot cap, comprising:

a crown having an upper connecting portion and a lower connecting portion, said upper connecting portion being higher than lower connecting portion; and a top knot portion having a first edge connected to the crown at the junction of the upper connecting portion and the lower connecting portion; and a plurality of binding cords attached proximate the top knot first edge, the cords having a first end fastened to the upper connecting portion and a second end connected to the lower connecting portion, wherein the upper connecting portion is a ring.

* * * * *